United States Patent [19]

Hawthorne

[11] 4,393,957

[45] Jul. 19, 1983

[54] METHOD OF ELIMINATING TRUCK HUNTING IN RAILWAY TRUCKS

[76] Inventor: V. T. Hawthorne, 310 Danell Rd., Radnor, Pa. 19087

[21] Appl. No.: 228,976

[22] Filed: Jan. 27, 1981

[51] Int. Cl.[3] ..... B61K 3/00

[52] U.S. Cl. ..... 184/3 R; 105/157 R

[58] Field of Search ..... 184/3 R, 101, 102; 188/33, 34; 105/157 R, 197 DB

[56] References Cited

U.S. PATENT DOCUMENTS

| | | | |
|---|---|---|---|
| 166,548 | 8/1875 | O'Sullivan et al. | 184/3 R |
| 364,001 | 5/1887 | Fisher | 184/3 R |
| 383,558 | 5/1888 | Criswell | 184/3 R |
| 480,982 | 8/1892 | Wohlfarth | 184/3 R |
| 699,747 | 5/1902 | De Lapp | 184/3 R |
| 742,786 | 10/1903 | Green | 184/3 R |
| 830,241 | 9/1906 | Love | 184/3 R |
| 1,111,308 | 9/1914 | Kincaid et al. | 184/3 R |
| 1,160,385 | 11/1915 | Crouch et al. | 184/3 R |
| 1,277,236 | 8/1918 | Mattison | 184/3 R |
| 1,915,216 | 6/1933 | Clark | 184/3 R |
| 1,972,371 | 9/1934 | Bonnifield | 184/3 R |
| 2,184,969 | 12/1939 | Allen | 184/3 R X |
| 2,589,582 | 3/1952 | Strughold et al. | 184/3 R X |
| 3,165,171 | 1/1965 | Baeriswyl | 184/3 R |

*Primary Examiner*—David H. Brown

*Attorney, Agent, or Firm*—Thomas E. Beall, Jr.

[57] ABSTRACT

Truck hunting is eliminated in railway vehicles by applying a low coefficient of friction material to the vehicle wheels so that a lubricating film is provided between the vehicle wheels and the rail on which they ride which serves to increase the critical speed of a rail vehicle, i.e., the speed at which truck hunting occurs, to a value above its operating speed.

8 Claims, 7 Drawing Figures

METHOD OF ELIMINATING TRUCK HUNTING IN RAILWAY TRUCKS

BACKGROUND OF THE INVENTION

This invention relates to the stabilization of railroad vehicles and more particularly to a method of eliminating truck hunting in rail vehicle trucks.

The conventional freight car truck consists of three structural members: a bolster and two side frames. The bolster has a center plate bowl which supports the freight car body. At the ends of the bolster there are flat surfaces which receive the top surface of resilient means which supports the ends of the bolster. The side frames have a mating surface for receiving the opposite ends of the resilient members. There are jaws on the extreme ends of the side frames for receiving an adapter arrangement which connects to the bearings of the axle/wheel sets. The wheel sets consist of outboard roller bearings and steel wheels pressed onto an axle. The steel wheels have a special tread contour where they contact the rail.

Brake rigging which is supported by the truck members provides the braking force when the brake linkage is actuated. The primary elements of the brake linkage are the brake beams, levers and brake shoes. The brakeshoes are attached to the ends of the brake beams and form the interface at the wheel when the braking force is applied to the brake linkage.

Truck hunting is a dynamic instability inherent in the railroad freight car truck described above aggrevated by the interaction between the rail head and the contour of the wheel tread and transferred through the side frame and bolster members of the trucks. At a critical speed, depending primarily upon the weight of the car body, the condition of the rail and wheel tread, and the damping and spring rate of the suspension, the truck vibrates due to a parallelogramming action described below.

Prior solutions to the problem of truck hunting are concerned with maintaining the rail car truck in a square or non-parallelogrammed position by stiffening or damping the truck itself.

The problem is recognized and described in U.S. Pat. No. 4,103,623 and overcome by placing a friction member between the truck side frames and bolster which tends to resist and control the parallelogramming motion of the truck.

U.S. Pat. No. 4,103,624 also addresses the problem of truck hunting. An integral H-frame truck is disclosed which increases the speed at which the instability that results in truck hunting occurs.

U.S. Pat. No. 3,687,086 and U.S. Pat. No. 3,714,905 disclose railway trucks having wedge means between the truck bolster and side frame to maintain truck squareness and thereby reduce wheel wear. The truck hunting phenomenon is not specifically described, however.

SUMMARY OF INVENTION

In view of the preceding discussion, it is the main object of this invention to provide a new method of eliminating the truck hunting phenomenon by increasing the critical speed to a value above the operating speed of a freight car. More particularly, it is an object of this invention to provide a method of eliminating truck hunting by applying a lubricating film between the wheels of a rail vehicle and the rail on which they ride.

These objects are attained by either dripping or spraying a lubricating fluid directly onto the rail vehicle wheels or incorporating a solid lubricant, such as silicone, in the brakeshoe associated with each wheel so that when the brakes are applied a film of lubricant will be applied to the wheels.

The present applicant has had considerable experience in studying the truck hunting phenomenon and on several occurrences during tests, it was noted that the presence of dry, blowing snow and/or rain performed a more satisfactory solution to the truck hunting problem than was possible with all the various prior art truck designs which applicant has seen tested.

DETAILED DESCRIPTION

Figure 1:
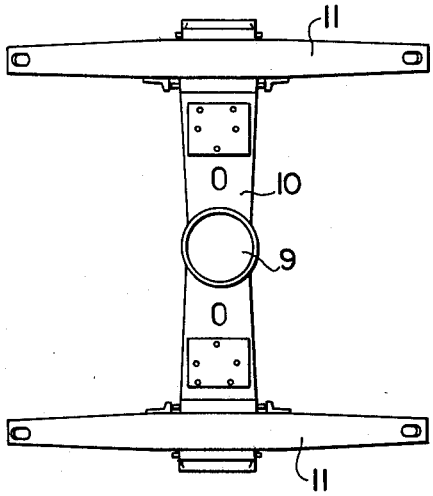
FIG. 1 is a top view of a standard railway truck.
Figure 3:
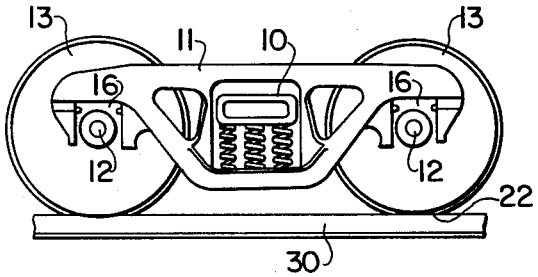
FIG. 3 is a side view of a standard railway truck positioned on a rail.
Figure 2:
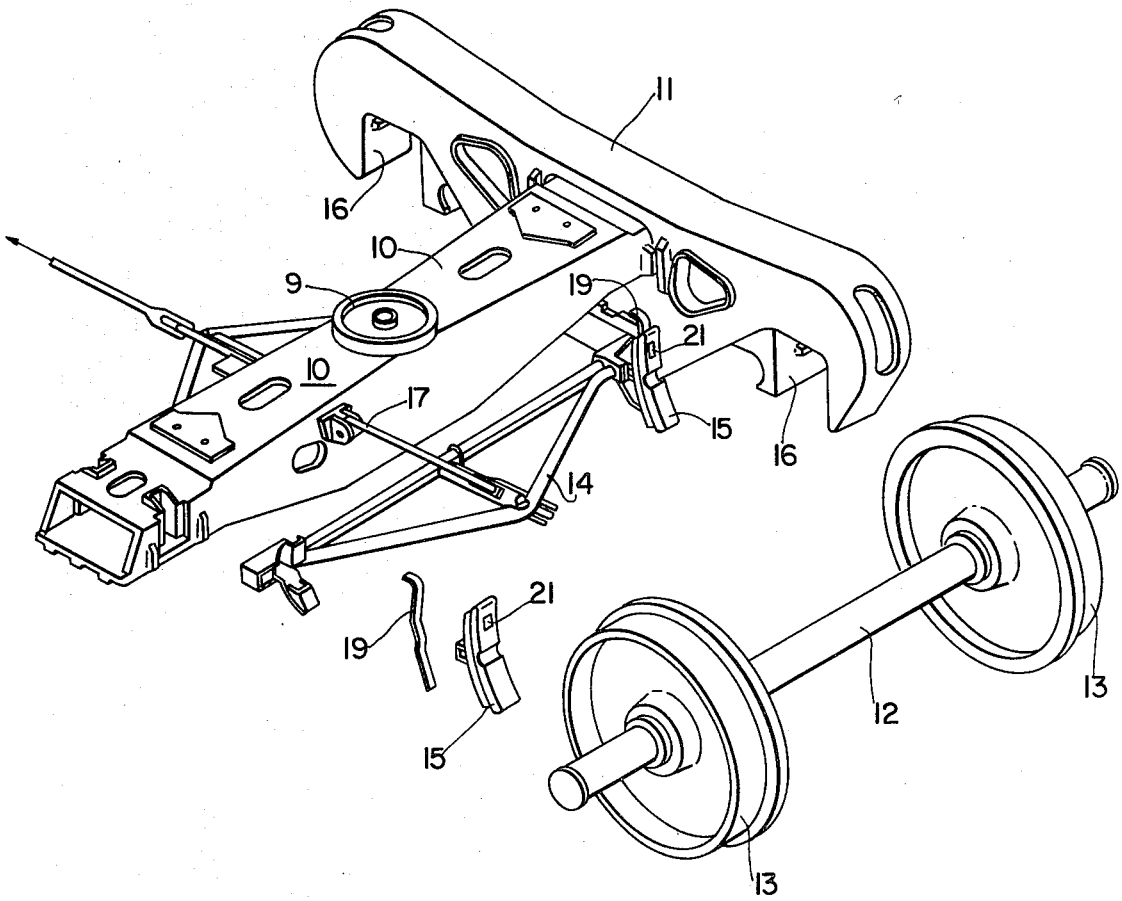
FIG. 2 is a plan perspective view of a standard railway truck.

Conventional railway structure is shown in FIGS. 1, 2 and 3. A bolster 10 has a center plate 9 on which is supported a freight car body. At each end of the bolster 10 are side frame members 11 having jaws 16 on their extreme ends for receiving the axle 12, which has wheels 13 press fitted thereon. Bearings (not shown) support the axle in the side frame jaws.

In FIG. 2, the bolster member 10 supports a brake rigging which is made up of brake beams 14, levers 17, and brakeshoes 15. The brakeshoes 15 are attached to the ends of brake beams 14 with lock keys 19 and form the interface at the wheel 13 when a brake force is applied to the brake linkage.

Figure 4:
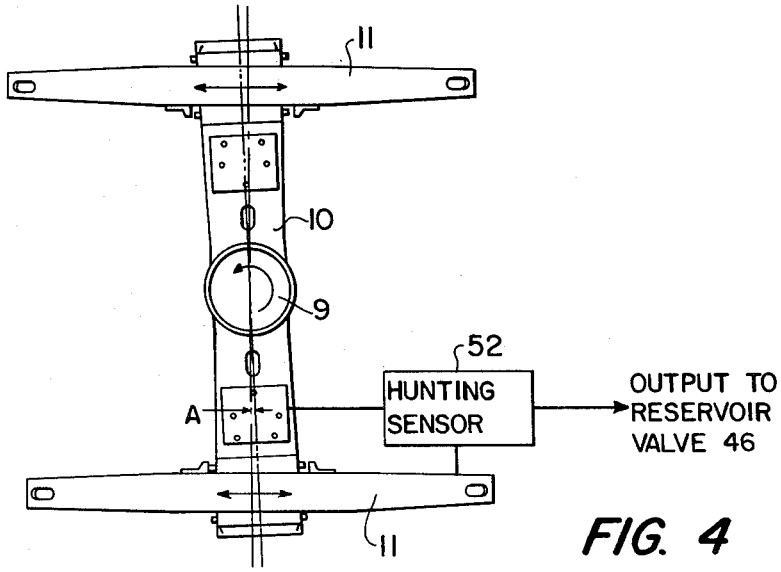
FIG. 4 is a top view of a standard railway truck undergoing parallelogramming motion.

Depending upon wheel and rail condition, as well as vehicle weight and suspension parameters the trucks of each railway car in a train will tend to vibrate when a critical speed is reached. At this critical speed, the interaction of wheel members 13 and rail 30 (FIG. 3) causes a rapid parallelogramming or "hunting" motion to occur in the truck members best shown in FIG. 4. The side frames 11 move back and forth relative to the center plate 9 in a motion indicated by the arrows. The bolster 10 turns through an angle A. The speed at which this parallelogramming motion occurs is the critical speed mentioned above. Truck hunting is described and prior solutions are disclosed in ASME Paper 79-WA/RT-14, authored by the present applicant and incorporated herein by reference. None of the prior solutions address the problem at the wheel/rail interface by altering the coefficient of friction.

This parallelogramming motion, or truck hunting, can be eliminated by a lubricating film at the rail/wheel interface indicated at 22 in FIG. 3. In one embodiment, best shown in FIGS. 2 and 6, a block of solid lubricant 21 of any suitable low coefficient of friction material is placed in a similarly shaped recess 23 in brakeshoe 15.

When the brakes are applied to the wheel, a film of the lubricant will be left on the wheel to lubricate the wheel/rail interface 22 shown in FIG. 3. It is understood, of course, that the braking ratio will have to be increased in order to overcome the lubricating effect of the lubricant.

Figure 6:
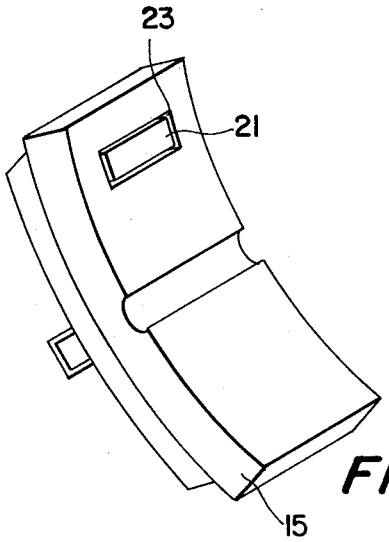
FIG. 6 is a perspective view of a brakeshoe incorporating a block of silicone.
Figure 7:
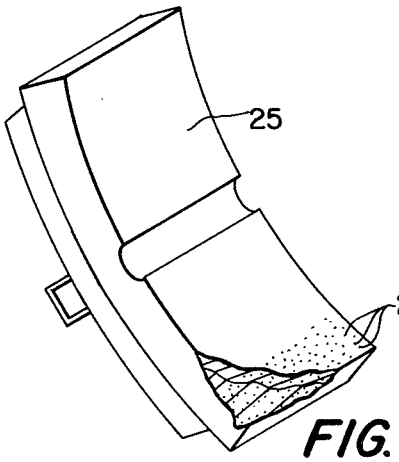
FIG. 7 is a perspective view of a brakeshoe impregnated with silicone.

When a composite brakeshoe is used, as shown in FIG. 7, the brakeshoe pad 25 which contacts the wheel 13 is impregnated with lubricant 26 as an alternative to the solid block of lubricant 21 of FIG. 6. As the brakeshoes wear, new lubricant will be present for application to the rail wheel similar to the embodiment above.

Figure 5:
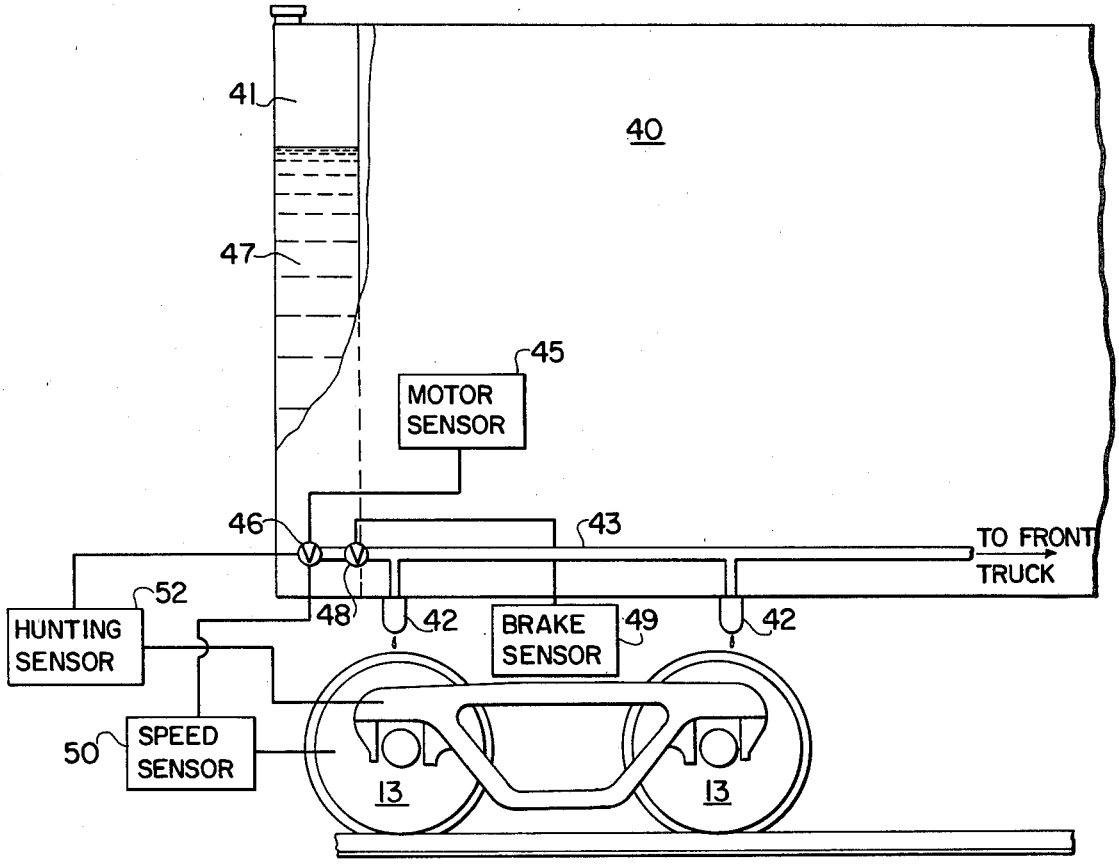
FIG. 5 is a vertical section of a rail car employing the fluid distribution system of the present invention.

In a second embodiment, shown in FIG. 5, a rail car 40 has a fluid reservoir 41 located thereon. A fluid conduit 43 located either inside (as shown) or underneath the rail car 40, conducts the fluid, preferably water, from the reservoir 41 to nozzles 42. The nozzles 42 meter the fluid onto the wheels 13. When water is used, it is dripped at a relatively slow rate onto the wheels, for example, one drop per minute.

A motion sensor 45 on rail car 40 controls a solenoid operated valve 46 in the fluid conduit 43 so that the fluid 47 in the reservoir passes through the conduit 43 to the wheels 13 only when the rail car 40 is moving.

In addition, a valve 48 located downstream of valve 46 is operated by a brake sensor 49 which closes the valve 48 whenever the brakes are applied to stop the gravity flow of fluid onto the wheel of the rail vehicle. This brake sensor 49 could be a mechanical switch thrown by movement of the brake rigging shown in FIG. 2. Valve 48 could be a solenoid operated valve like valve 46 or, as an alternative, could be pneumatically operated using the air of the air brakes as its actuating means. In any case, when the brakes of the rail vehicle are applied, fluid flow to the wheels is ceased.

Valve 46 could also be operated by the input of a speed sensor 50 in FIG. 5, the output coming from the vehicle wheel 13. A speed signal is derived from the wheel 13 and fed into speed sensor 50. The speed sensor 50 compares the input signal with a reference signal correlated to the critical speed at which hunting occurs (discussed above) and produces a signal to open valve 46 only when the vehicle speed is above the critical speed. Fluid then flows by gravity to the wheel to eliminate the hunting.

Lastly, valve 46 could be operated by hunting sensor 52. Rapid relative motion between the truck side arms 11 and bolster 10 is sensed by hunting sensor 52. The output of sensor 52 is used to open valve 46 to allow the fluid film to be applied to wheel 13.

The structure of the speed sensor 50 or hunting sensor 52 is irrelevant. The method of the present invention merely calls for sensing speed or hunting to provide an appropriate signal. Any suitable sensor can be employed.

It should also be noted that brake sensor 49 is used in conjunction with either the speed sensor 50 or the hunting sensor 52 as well as the motion sensor 45 to stop the fluid flow to the wheels when the brakes are applied.

The reservoir 41 could be opened at the top in order to collect rain or snow for subsequent use as a wheel lubricant.

By either of the above-outlined methods, truck hunting can be eliminated. The drawings and specifications show only a few embodiments of the present invention. These embodiments are not intended to limit the invention and several other methods can be carried out without departing from the scope of the present invention.

What is claimed is:

1. In the operation of a rail vehicle having trucks with rail contacting wheels and brakes with brake shoes associated with each of said wheels, said rail vehicle being associated with other similar rail vehicles and pulled by a locomotive means, said trucks on each of said pulled rail vehicles tending to vibrate or hunt when pulled by said locomotive means at a speed above a critical speed, a method of eliminating said vibration or hunting to increase the critical speed of said rail vehicle to a value above its operating speed comprised of:

sensing the speed of said vehicle and producing a correlated speed signal;

comparing said speed signal to a fixed reference signal correlated to the critical speed; and applying a low coefficient of friction material to the wheels of said rail vehicle to provide a lubricating film between said wheels and the rail on which they ride only when said speed signal exceeds said reference signal.

2. The method of claim 1, wherein said low coefficient friction material is water.

3. The method of claim 1, wherein said step of applying draws water by gravity flow to nozzles located above each wheel from a reservoir located on each of said rail vehicles through a fluid conduit connecting said nozzles and said reservoir, and includes constantly dripping the water from the nozzle onto each of said wheels to provide a lubricating film.

4. The method of claim 3, including ceasing said gravity flow of water to said wheels when said brakes are actuated.

5. In the operation of a rail vehicle having trucks with rail contacting wheels and brakes with brake shoes associated with each of said wheels, said rail vehicle being associated with other similar rail vehicles and pulled by locomotive means, said trucks on each of said pulled rail vehicles tending to vibrate or hunt when pulled by said locomotive means at a speed above a critical speed, a method of eliminating said vibration or hunting and increasing the critical speed of said rail vehicle to a value above its operating speed comprised of:

sensing truck hunting in said vehicle truck and producing a correlated hunting signal; and applying a low coefficient friction material to the wheels of said rail vehicles to provide a lubricating film between the wheels and the rail on which they ride only when a hunting signal is produced.

6. The method of claim 5, wherein said low coefficient of friction material is water.

7. The method of claim 5, wherein said step of applying draws water by gravity flow to nozzles located above each wheel from a reservoir located on each of said rail vehicles through a fluid conduit connecting said nozzles and said reservoir, and includes constantly dripping the water from the nozzle onto each of said wheels to provide said lubricating film only when said hunting signal is produced.

8. The method of claim 7, including ceasing said gravity flow of water to said wheels when said brakes are actuated.

* * * * *